US005740850A

United States Patent [19]

Hoffman

[11] Patent Number: 5,740,850

[45] Date of Patent: Apr. 21, 1998

[54] SEPARATION RESISTANT SLAT CONNECTIONS FOR FOLDING SHUTTERS

[76] Inventor: Robert E. Hoffman, 5618 Riviera Dr., Coral Gables, Fla. 33146

[21] Appl. No.: 693,364

[22] Filed: Aug. 6, 1996

Related U.S. Application Data

[63] Continuation of Ser. No. 504,467, Jul. 20, 1995, Pat. No. 5,566,739.

[51] Int. Cl.[6] ..... E05D 15/26

[52] U.S. Cl. ..... 160/183; 160/233

[58] Field of Search ..... 160/183, 233, 160/235, 196.1, 199, 206, 236, 229.1, 213, 113, 114, 118, 119, 135

[56] References Cited

U.S. PATENT DOCUMENTS

| | | |
|---|---|---|
| 3,485,287 | 12/1969 | Milbourne, Sr. . |
| 3,670,797 | 6/1972 | Sassano . |
| 4,386,645 | 6/1983 | Dever et al. . |
| 5,097,883 | 3/1992 | Robinson et al. . |
| 5,099,904 | 3/1992 | Susnar . |
| 5,469,905 | 11/1995 | McKinney et al. . |
| 5,472,037 | 12/1995 | Hoffman . |
| 5,477,903 | 12/1995 | Figueiredo et al. . |
| 5,566,739 | 10/1996 | Hoffman ..... 160/183 |

*Primary Examiner*—David M. Purol
*Attorney, Agent, or Firm*—Harness, Dickey & Pierce, P.L.C.

[57] ABSTRACT

The opposite vertically elongated edges of a series of pivotly connected slats forming an accordion type folding shutter are provided with integral tubelike connector members. The slat integrally joins its outer member along a plane which is tangent to the outer surface of the outer member so that the extended adjacent pair of slats form a roughly ninety (90°) degree angle when the shutter is extended. Thus, the forces of impact applied against the shutter is absorbed by the crushing of the outer member towards and against and then with the inner member, in engagement between the adjacent inner and outer member beads and the partial transmission of forces through the adjacent portions of the slats for resisting separation of the adjacent slats and penetration of the force applying object.

3 Claims, 4 Drawing Sheets

SEPARATION RESISTANT SLAT CONNECTIONS FOR FOLDING SHUTTERS

This is a continuation of U.S. patent application Ser. No. 08/504,467, filed Jul. 20, 1995 now U.S. Pat. No. 5,566,739.

BACKGROUND OF INVENTION

This invention relates to an improved pivotal connection between the narrow slats which form an accordion-type folding shutter which substantially increases the resistance to slat separation caused by impacts against the shutter.

Conventional accordion-type folding shutters generally comprise numerous, vertically arranged, narrow slats which are pivotly connected together along their adjacent edges. The shutters may be extended or unfolded to overlay or cover an opening formed in a building, such as a window or door opening. Alternatively, the shutter may be folded so that its slats are compressed together to clear the opening. Normally, the shutters are extended for the purpose of protecting against intrusion or penetration through the building opening. Therefore, the shutters must be made in such a manner as to resist the forces that are applied by the impact of wind-hurled objects or manually applied objects.

Since conventional shutters are typically connected together by tube-like connector formations formed on the opposite edges of the respective slats, with one formation or member being sized to fit within and to pivot within the adjacent member, substantial impact forces can break apart or separate adjacent slats at their connections. Thus, conventional shutters are vulnerable to penetration or slat separation due to relatively strongly applied impacts against the pivotal connections between their adjacent slats.

Examples of such types of accordion folding shutters and of the connections between their adjacent slats are disclosed in U.S. Pat. No. 3,670,797 issued Jun. 20, 1972 to Sassano (e.g., see FIGS. 4 and 5 of the drawings) and U.S. Pat. No. 5,097,883 issued Mar. 24, 1992 to Robinson et al. (e.g., see FIGS. 8, 10 and 11).

In U.S. Pat. No. 3,670,797, an inner, tubular-like pivot member (e.g., see FIG. 5) having a substantially greater wall thickness than the remainder of the slat, fits within an outer pivot member. The outer tubular-like member is provided with inwardly extending edge beads along the edges which define a slot through which a bent edge of the slat is fitted for integral connection with the inner tube-like member. Although, those beads assist in spacing the outer surface of the inner member from the inner surface of the outer member, they tend to axially mis-align the inner and outer members, particularly during folding and unfolding of the shutters.

The pivotal connection system disclosed in U.S. Pat. No. 5,097,883, includes an inner tube-like member on one slat fitted within an outer tube-like member on the next slat. The inner member is connected, through a short, angularly bent-edge portion, to its respective slat. Each of the inner and outer members is provided with an elongated slot. The edges of the outer member slots have inwardly extending beads. The edge of the inner member slots have outwardly extending beads (e.g., see FIGS. 10 and 11). However, those bead constructions limit the angle between adjacent slats to approximately 60 degrees when the shutter is extended. Hence, a considerable number of slats are required to cover a given lineal distance. That construction, also, tends to require relatively wide and thick slats and have a limited resistance to separation of the slat connections under impact.

The present invention relates to an improved pivotal connection which substantially increases the separation and penetration resistance of the slat connections and permits the use of thinner, relatively narrower slats which extend apart at a considerable angle as compared with the above-described shutters.

SUMMARY OF INVENTION

This invention relates to an improved, substantially rigidified, separation resistant, pivotal connection between slats used in accordion-type foldable shutters. Such shutters comprise vertically arranged, elongated, narrow, thin slats which are joined together, edge-to-edge, by a hinge-forming arrangement by which the shutter may be extended for covering a building opening or may be folded to clear the opening. The connection is provided by integrally forming pivotally interfitted tube-like members upon the opposite elongated edges of the slats. One tube-like member is of a smaller diameter than the other member so that the smaller diameter member may be co-axially positioned within the outer, larger member of the next slat for pivoting therein.

The outer, tube-like member, is formed in a generally circular cross-sectional shape with a slot which spans roughly a third of the circumference of the member. The edges which define the slot are formed with radially inwardly directed beads. The smaller or inner tube-like member of the next slat, is co-axially arranged within the outer member and is connected, by a narrow bent-edge strip to the slat. The narrow strip extends through the slot in the outer member. Thus, the inner member may be pivoted relative to its respective outer member along an arc equal to the width of the slot in the outer member.

The inner, tube-like member, is also provided with a slot extending along its length and the edges of the material defining that slot are provided with radially outwardly extending integral beads. These are positioned to swing within the inner wall surface of the outer tube-like member.

The vertical edge of the slat is connected to its outer tube-like member along a plane which is tangent to the outer member along a line which is slightly angularly offset from a plane which diametrically bisects the outer member. Also, one bead of the outer member is arranged to engage against the bent strip to form a stop which angles the respective slats, when the shutter is extended, through an angle of about 90 degrees. The other bead of the outer member is positioned to engage the opposite side of the strip when the slats are folded together and, in addition, to engage the outwardly extending bead of the inner member when the slats are arranged in their 90 degree angle position. In such angled position, the inwardly extending bead of the outer member and the outwardly extending bead of the inner member jointly form a reinforced column-like strip extending vertically along the length of the connection for reinforcing the connection and for locking the connector members against separation under impact. The second, outwardly extending bead on the inner member normally positions the surface of the inner member away from the inner surface of the outer member.

The foregoing connector arrangement provides a vertically arranged, tube-like construction at the intersection of each of the slats which make up the shutter. The slats may be made narrower than conventional so that there are more of these vertically extending, tube-like strips along the full extended width of the shutter. Nevertheless, even where the slats are narrower, because of the wider angle, i.e. about 90 degrees, attainable when the slats are extended, it is possible to use of the same or even fewer slats than might otherwise be required in the type of connections described in the above-mentioned prior patents.

An overall object of this invention is to provide a system for dissipating the forces relating from manually applied impacts or the impacts of wind-hurled objects, such as debris hurled by hurricane winds. The forces are absorbed by successively crushing the impacted portion of the connector outer member inwardly towards and against the inner connector member and then successively crushing both members together and, forcing the inter-engaged beads more tightly together which simultaneously resists separation of the members. In addition, the forces are partially dissipated through the adjacent angularly arranged slats.

A further object of this invention is to provide pivotal joints or connections between the adjacent slats of a folding-type shutter which connections absorb substantially greater forces of applied impacts and more effectively resist separation of adjacent slats at their connections than prior slat connections.

Another object of this invention is to provide an inexpensive pivotal interconnection between adjacent slats of a folding shutter which provides considerably greater, resistance to impacts to while permitting the use of relatively thinner, narrower and lighter weight slats than what might otherwise be required for equivalent protection.

Still a further object of this invention is to provide an improved pivotal hinge-like joint for the slats of a folding shutter which enable the use of narrower slats which cover a greater lineal distance when the shutter is unfolded, to thereby increase the number of reinforcing joint constructions in the shutter.

These and other objects and advantages of this invention will become apparent upon reading the following description, of which the attached drawings form a part.

DETAILED DESCRIPTION

Figure 1:
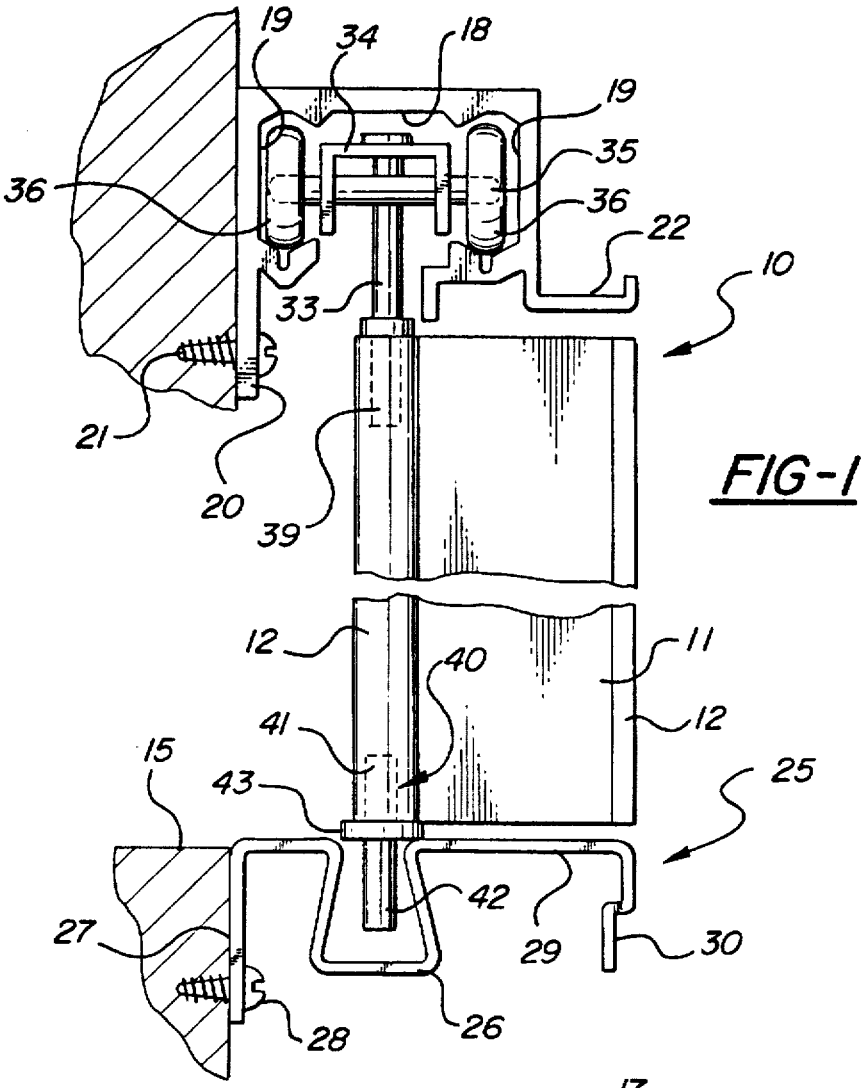
FIG. 1 schematically illustrates, in side elevation view, a shutter mounted upon the wall of a building for covering an opening therein.
Figure 2:
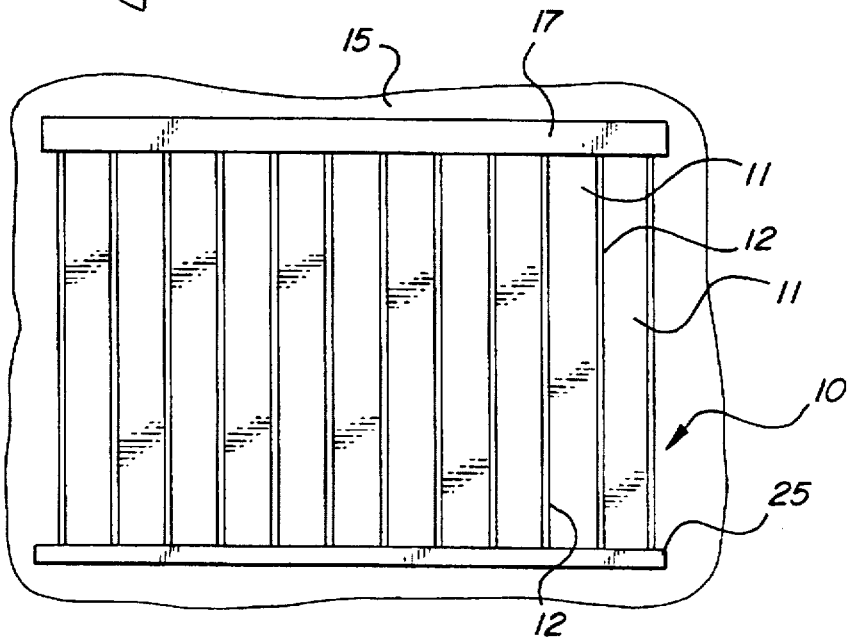
FIG. 2 is a schematic, front elevational view, of the shutter covering the opening.
Figure 3:
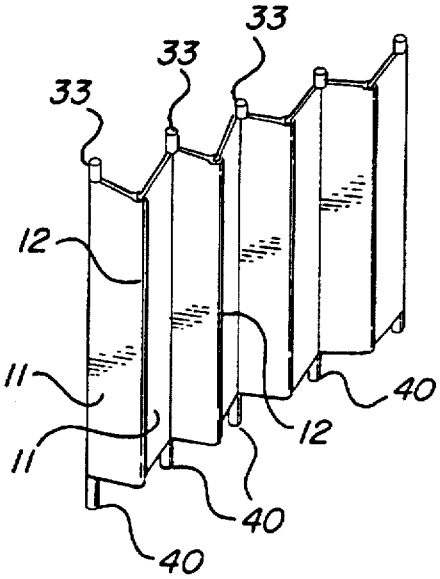
FIG. 3 is a schematic, perspective view, showing the shutter extended into its covering position.

FIGS. 1–3 illustrate an accordion-type folding shutter 10 which is formed of numerous, identical narrow, substantially flat, elongated vertical slats 11. The adjacent edges of the slats are pivotally connected together by tube-like pivotal connections 12 which will be described in detail later. The arrangements of the shutter, slats and their connections are conventional and, therefore, are schematically described. The invention herein relates to the specific construction of the connections which, otherwise, are used in conventional shutter constructions.

Accordion-fold shutter slats typically are formed of extruded metal, such as aluminum, or extruded plastic. The interconnected slats form the shutter which is arranged to cover, when the shutter is extended or unfolded, an opening 14 in a building wall. The opening may be a window, a door, or an open doorway or the like, formed in the wall of a building 15.

Referring to FIG. 1, the shutter is mounted from an upper, header track 17 which, for example, may be formed of extruded aluminum material. The track comprises an inverted, open channel 18 with inner, side channels 19. An integral side flange 20 may be attached to the building structure by screws 21 or other suitable fasteners. In addition, the track may include an outwardly extending guide flange 22 which will cover the upper end of the shutter, as illustrated in FIG. 1.

A lower sill or threshold track 25 is mounted beneath, and in alignment with, the upper header track. The sill track may be formed of an extruded material, such as of aluminum, into the shape of an upwardly opening channel 26. An integral mounting flange 27 is shaped for application against the adjacent building structure and may be secured thereto by means of screws or similar mechanical fasteners 28. The sill track may include an outwardly extending bottom plate or strip 29 which terminates in a downwardly extending trim flange 30.

The cross-sectional shapes of the header track and the sill track may be varied considerably and, therefore, the foregoing description should be viewed as illustrative of a conventional form of mounting a foldable shutter, in this instance, across a window opening in a building wall.

An upper pin 33 is secured to every other slat pivotal connection, as shown in FIG. 3. The upper pin may be connected to a bracket 34 (see FIG. 1) which is generally inverted U-shaped in cross-section. An axle 35 extends through or is fastened to the depending legs of the bracket and wheels 36 are secured upon the opposite ends of the axle. These wheels rotatably fit within the side channels 19 in the upper, header track. Thus, the wheels, the bracket to which the wheels are attached, the upper pins and, consequently, the upper ends of alternating connections between the slats are movable longitudinally along the length of the upper track 17.

The upper pins may include a suitable, washer or ring-shaped flange 38 which engages the upper ends of their respective slat connections. The lower ends 39 of each pin 33 are fastened within their respective connections 12 in any suitable manner, as for example, by forming the lower ends of the pins with a self-tapping thread which will threadedly fit within and engage the surrounding surfaces of the adjacent wall of the connections. The manner of securing such pins within their connections is conventional.

A lower pin 40 is secured within the lower ends of each alternating slat connection, as illustrated in FIG. 3. Each lower pin has an upper end 41 which is fastened within its respective connection. The connection may be made by forming the upper end of the pin with a self-tapping thread for threadedly engaging and connecting with its respective pivotal connection. The manner of securing the lower pins in place is conventional and, therefore, no further description is given here. The lower end 42 of each lower pin slideably fits within the channel 26 in the lower or sill track 25 for slideable movement along the length of that track. A stop collar or washer 43 fastened upon each pin is arranged to engage the lower track, spanning the open mouth of the upwardly opening channel 26 to appropriately position the slat connections above the lower track. Other suitable mechanical means may be utilized, as is conventional in accordion-type folding shutter constructions.

Figure 7:
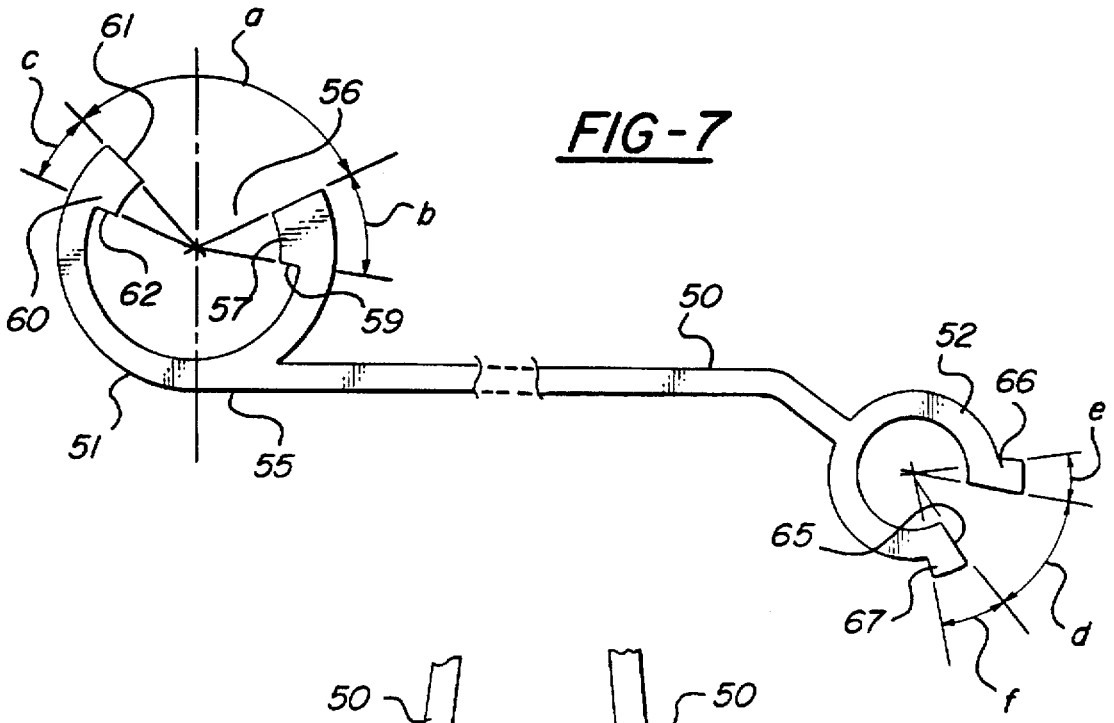
FIG. 7 is an enlarged, plan view, of a single slat.

As illustrated in FIG. 7, each slat 11 is formed of a generally flat, vertically elongated, narrow body portion or member 50. An outer, tube-like connection member 51 is integrally formed on one elongated edge of the body member. Similarly, an inner, tube-like connector member 52 is integrally formed on the opposite edge of each body member. The inner connector members are integral with a bent-edge strip 53 which is formed on the body member. The bent-edge strip 53 is preferably arranged at an obtuse angle relative to the plane of the slat body member 50.

Figure 8:
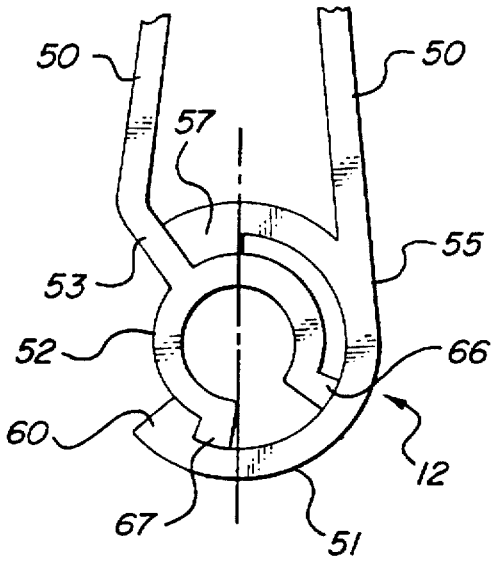
FIG. 8 is an enlarge, plan view, of the pivotal connection between adjacent ends of a pair of slats, with the slats shown in folded condition.
Figure 9:
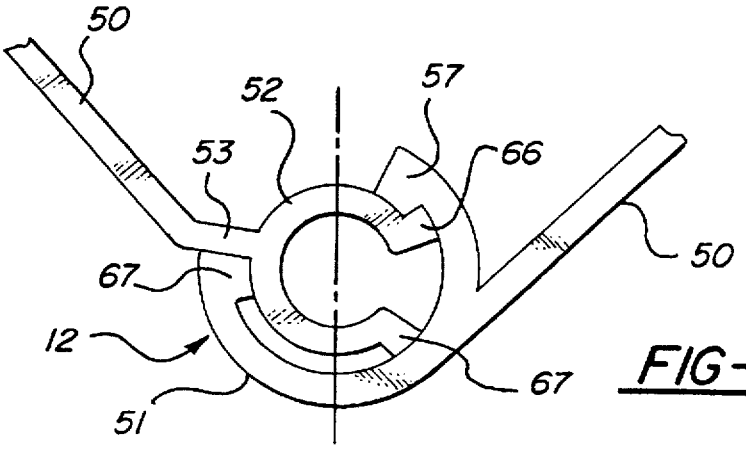
FIG. 9 is a view of similar to FIG. 8, showing the adjacent slats pivoted into their shutter unfolded or covering position.

The body member is arranged tangent to the outer connector member 51 and is integral therewith along a line 55 which is offset, roughly 30 degrees in a circumferential direction, from the plane which bisects the outer connector member. The degree of offset may varied, but, as illustrated in the drawings of FIGS. 7–9, the generally flat body portion of the slat is substantially tangent to the periphery of the outer connection member.

The outer connection member is provided with a continuous, elongated slot 56. The slot forms an arc "a" which is nearly, about ⅓rd of the circumference of the generally circular cross-section of the outer connector member.

A radially inwardly extending first bead 57 is formed on one of the edges defining the slot 56. The opposite side edges 58 and 59 of the bead are substantially aligned radially with the center of the connector. A second bead 60 is integrally formed with the opposite edge defining the slot 56 and, similarly, its opposite edges 61 and 62 are substantially radially aligned with the center of the connector member. Preferably, the bead 57 is longer, in the circumferential direction, than the bead 60. This is illustrated by showing the arc "b" of the bead 56 being visually larger than the arc "c" of the second bead 60.

The inner tube-like connector member 52 of each slat is provided with a continuous, elongated slot 65 which spans approximately ¼ of the circumference of the substantially circular, in cross-section, connector. The arc of the slot is schematically illustrated by the angle "d". (See FIG. 7.) In addition, the radially inwardly inclined edge beads 66 and 67 are formed on the edges defining the slot 65 in the inner connector. These edge beads may be of approximately the same arcuate or circumferential length, in cross-section. Thus, the arcuate lengths of beads 66 and 67 are designated as "e" and "f," respectively.

Figure 6:
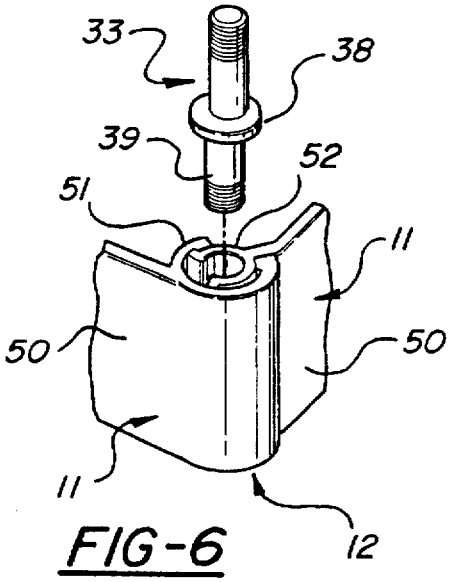
FIG. 6 is an enlarged, fragmentary view, of a portion of the connection between adjacent slats and illustrating a shutter connection pin for securing the shutter to a support track, with the pin separated from the connection for illustration purposes.

As illustrated in FIG. 6, the upper pin 33 has its lower end 39 inserted within the inner connector member 52 and is secured therein either by a self-tapping thread or by other mechanical means. Similarly, the upper end portion 41 of the lower pin 40 is inserted and fastened within the lower end of the inner connector member 52.

Figure 4:
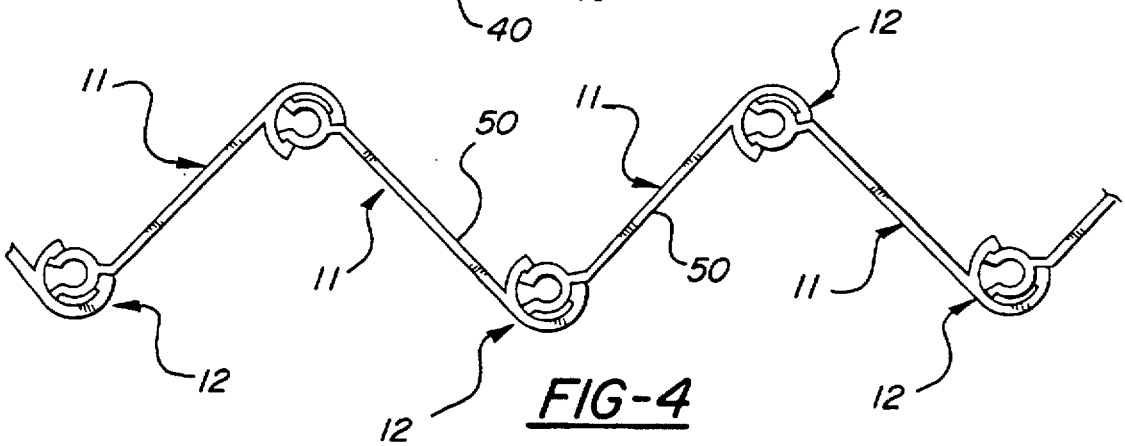
FIG. 4 is a plane view, to an enlarged scale, of a portion of the shutter shown in extended or unfolded position for covering an opening.
Figure 5:
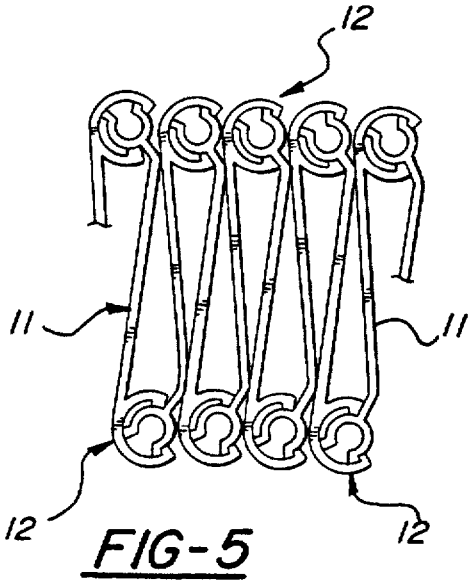
FIG. 5 is a plane view, showing the shutter in its folded or compressed condition for uncovering an opening.

The shutter is mounted within the upper and lower tracks, in the conventional manner, by moving the respective pins and the wheels on the upper pins endwise into the channels. Once the shutter is mounted within the tracks, the shutter may be unfolded to cover the building opening or folded to uncover the building opening. FIG. 4 illustrates a fragment of the shutter showing the slats moved into the unfolded or covering position. FIG. 5 illustrates the shutter folded with the slats comprised against each other for uncovering the opening in the building.

FIG. 8 is an enlarged illustration showing the relationships between the inner and outer connector members when the shutter is folded, that is, when the slats are compressed together. In this condition, the first larger bead 57 of the outer connector member 51 contacts the bent-edge strip portion 53 of the slat body 50. At the same time, the bead 57 on the inner connector member contacts or is closely adjacent to the second bead 60 formed on the outer member. In this arrangement, the slats are closely compacted, as illustrated in FIG. 5.

When the slats are unfolded, they pivot about their respective connectors. In this condition, the pivoting occurs until the inner member bead 66 contacts or is closely adjacent to the outer member first bead 57 while the outer member's second bead 60 engages the opposite face of the bent-edge strip 53, as illustrated in FIG. 9. With this arrangement, a relatively large angle is formed between the adjacent slats. By way of example, the angle can be approximately 90 degrees which is normally larger than that obtained with conventional accordion-type fold shutters. For example, in the shutter disclosed in the prior U.S. Pat. No. 5,097,883, the angle between adjacent slats is disclosed as being approximately 60 degrees when the shutter system is fully deployed (see col. 6, lines 28–29).

The wider angle of opening the slats, relative to each other, permits the use of narrower slats to cover the same lineal distance that conventional, normally wider slats, cover. Thus, there are more connectors along any particular lineal coverage than might otherwise be utilized in conventional accordion-type shutters. The vertically arranged connectors provide reinforcing bars or columns which resist penetration of the shutter and, more significantly, resist separation of adjacent slats under applied impacts. In conventional shutter connections, there is a tendency for the slats to separate at their connections when subjected to a substantial force resulting from the impact of a wind-hurled object or a manually applied object. The present construction substantially increases the strength of resistance to penetration and separation at the connections between the slats.

Figure 10:
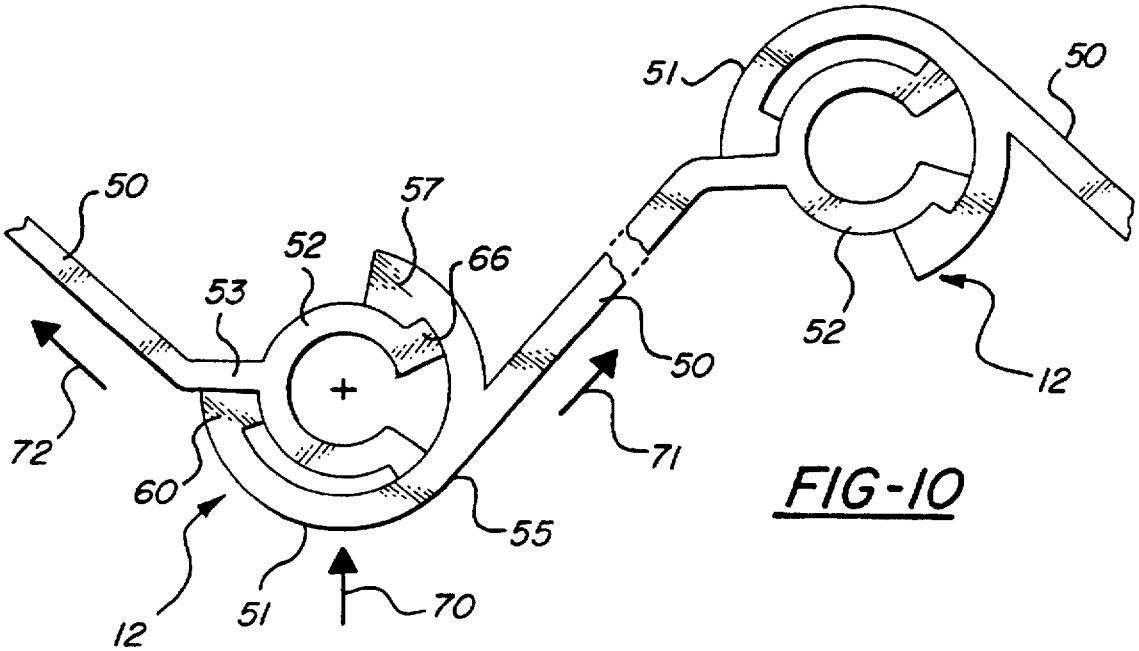
FIG. 10 is an enlarged, plan view, showing the connections between adjacent slats and schematically illustrating the application of the forces of an impact upon a slat connection and adjacent slats.
Figure 11:
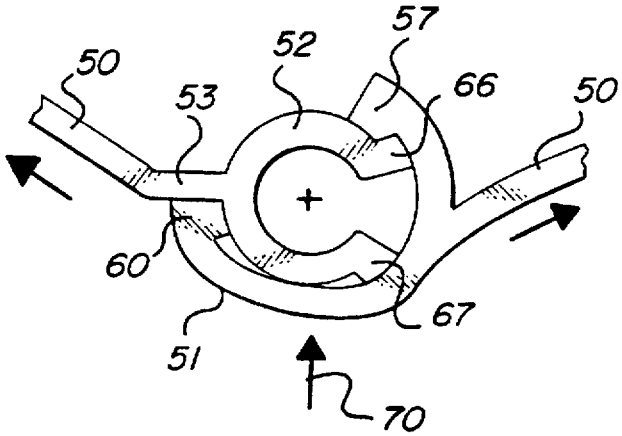
FIG. 11 is a view similar to FIG. 10, showing the effect of applied forces upon the slat connections.
Figure 12:
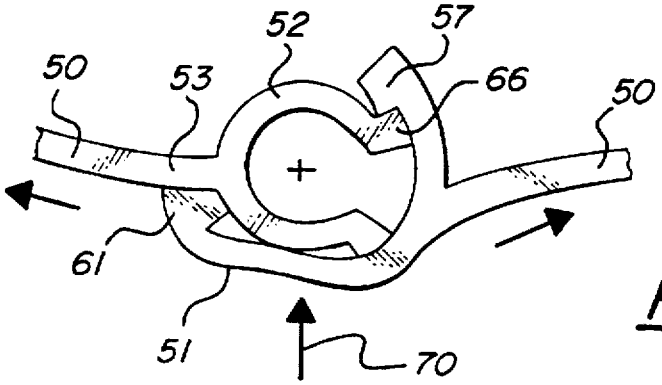
FIG. 12 is a view similar to FIG. 11, illustrating the effect of the application of greater forces upon the connection of adjacent slats.

FIGS. 10–12 schematically illustrate the effects of applied forces upon the slat connections. FIG. 10 is an enlarged view of two slat connections illustrated in the shutter unfolded position in which the shutter covers a building opening. A large force, schematically illustrated by the arrow 70, is applied against one of the connections. The force may be due to a wind-hurled object, such as building debris or the like, or by a manually applied object, such as a hammer intended to force open the shutter. The force is transmitted through the adjacent slats which would appear in a force vector diagram to act like the legs of an equilateral triangle.

In FIG. 11, the force is sufficient to cause the exposed or impacted portion of the outer connector member 51 to bend or crush radially inwardly. The bead 67 on the inner member resists the inward bending of the outer member. But, as the outer member bends or crushes, it applies pressure to the portion of the inner member, which it overlays. Thus, the inner member bends under the pressure of the bending or crushing portion of the outer member. Simultaneously, one of the slats bends along its narrow edge strip 53, due to the pressure of the bead 60 against that strip. The adjacent slat body, which is in a plane that was initially tangent to its outer member, bends to partially absorb the force.

As the force continues, or if a heavier force is applied, as shown in FIG. 12, the crushing or inwardly folding movement of the outer member engages and crushes or bends the inner member. Simultaneously, the two slat body portions bend even further to substantially flatten the triangular, in cross-section, shape of the connection between the slats. But, the engagement between the first bead 57 of the outer member and the bead 66 of the inner member becomes tighter even though the bead 57 may be bent slightly out of position. The tight engagement between the two beads 57 and 66 locks the inner and outer connector members together to prevent their separation due to the impact force.

Depending upon the intensity of the applied forces, the inner and outer connector members may bend, more or less. Likewise, the impact forces may cause greater or lesser flattening of the otherwise triangular configuration of the slats.

While the sizes and shapes of the parts forming the slat body portions and their respective connector members may vary, a practical or commercial set of dimensions, for illustration purposes, are as follows: with the slats extruded out of a conventional, aluminum material used for this type of product, the thicknesses of each slat may be on the order of about 0.1 inches and the widths approximately 4.0 inches to about 4.2 inches. The outer connector member may have a diameter of approximately 0.536 O.D. and 0.436 I.D. The arc "a" of the slot is approximately 99 degrees, with the arc small "b" of the first bead 57 is approximately 36 degrees and the arc small "c" of the second bead 60 approximately 26 degrees. The inner member may be approximately 0.320 O.D. and 0.22 I.D. with its slot arc "d" approximately 49 degrees and its bead arcs small "e" and small "f" about 22 degrees. The obtuse angle formed by the bent-edge strip 53 with its body member 50 is approximately 120 degrees.

The foregoing dimensions and angles are not critical but rather are approximate to illustrate the relationships of the components forming the pivotal connections and the relative proportions of the slats.

The overall construction of the shutter appears, to the observer, to be conventional in all respects. Thus, although the shutter does not appear to be different, nevertheless, it is able to withstand substantially greater impact forces than conventional shutters without any change in its acceptable aesthetic appearance. In addition, the construction permits the use of relatively thin, aluminum or plastic extrusions to provide the desired protection, that is, to avoid the necessity of substantially greater thickness and size slats which otherwise would substantially the expense of constructions.

This invention may be further developed within the scope of the following claims. Therefore, the foregoing description should be read as being merely illustrative of an operative embodiment and not in a strictly limiting sense.

I now claim:

1. A separation resistant slat connection for accordion-type folding shutters having a number of vertically elongated, narrow, generally flat slats that are pivotly connected together along their adjacent vertical edges for extending the shutter across a building opening or folding the shutter for clearing the opening, comprising:

each slat having integral, tube-like, connector formations provided upon its opposite, elongated vertical edges for pivotly interconnecting with corresponding connector formations on the next adjacent slat;

one of said connector formations being an outer connector member and the other of such connector formations forming an inner connector member of a size to fit, generally co-axially, within the outer member of the next slat;

each connector member having an elongated slot, extending along its entire length, with the slot in the outer member forming an opening, in cross-section, that is about ⅓rd of the circumference of the tube-like shaped outer member and the slot in the inner member forming a opening, in the cross-sectional direction, that is about ¼th of the circumference of the inner-tube member;

the opposite longitudinal edges which define the slot in the outer member each having an integral, radially, inwardly extending bead formed thereon;

the opposite edges defining the slot in the inner member each having an integral, radially, outwardly extending bead;

with the slat edge portion upon which the inner member is provided being formed in the shape of an integral, narrow, elongated strip, extending the full length of the slat, and extending at an obtuse angle relative to the remainder of the slat and being integrally joined with its inner member along a plane which approximately bisects the inner member and its slot;

the outer member is joined to the opposite edge portion of each slat along a plane that is tangent to the outer member along a line which is slightly angularly offset from a diametrical plane which bisects the outer member and its slot;

the integral narrow strip extends through the slot of its respective outer member and is pivotly moveable between the opposite edges defining the slot in its respective outer member;

the adjacent slats may be pivoted about their respective interfitted outer and inner members for extending the shutter into its covering position, at which time the adjacent slats may be arranged at approximately a 90 degree angle relative to each other with one edge bead of the outer connector member engaging said strip and with the second edge bead of the same outer member being arranged closely adjacent to one edge bead of its respective inner member to form therewith a double thickness bead reinforcement extending along the adjacent vertical edges of their slats, and with the second edge bead of the inner member being arranged within and closely adjacent to the interior surface formed within the respective outer formation near a diametrical plane which approximately bisects the approximately 90 degree angle formed by the two adjacent connected slats;

whereby the interfitted inner and outer connector members and their adjacent beads provide a structure which resists penetration of the shutter and resists separation of adjacent slats by forces resulting from a forceful impact against the shutter such that one slat bends due to the force and the adjacent slat bent to partially absorb the force, and whereby the shutter is foldable to arrange the slats in close face-to-face relationship.

2. A construction as defined in claim 1, and wherein each of said one edge beads formed on each outer member is narrower in the circumferential direction than the second edge bead that is formed on its respective outer member.

3. A construction as defined in claim 1, and wherein the edge beads formed on each inner member extends radially outwardly therefrom and terminates closely adjacent to the interior surface of the outer member, with the remainder of the periphery of the outer surface of the inner member being normally spaced radially inwardly a short distance from said inner surface of said outer member;

whereby the force of an impact applied against the shutter connection formed by the interfitted inner and outer members, when the shutter is in its extended position, is absorbed by the crushing of the impacted portion of the outer member towards and against the portion of the inner member which it overlays, and by the crushing of the adjacent portion of inner shutter and, also, by being transmitted in a generally planar direction crosswise of the two adjacent slat portions which otherwise form with their interfitted connector members, a generally triangular shape, and by bending of the narrow strip relative to the remainder of its respective slat to, thereby, reduce its obtuse angle, and by the engagement between the adjacent inner and outer connector member beads.

* * * * *